United States Patent [19]

Spitz et al.

[11] 4,183,307

[45] Jan. 15, 1980

[54] POLLUTION CONTROLLED INCINERATION SYSTEM

[75] Inventors: Albert W. Spitz, Elkins Park; Milton I. Schwab, Philadelphia, both of Pa.

[73] Assignee: Milpat Corporation, Glenside, Pa.

[21] Appl. No.: 928,142

[22] Filed: Jul. 26, 1978

Related U.S. Application Data

[63] Continuation-in-part of Ser. No. 806,831, Jun. 15, 1977.

[51] Int. Cl.[2] ..... F23G 7/00

[52] U.S. Cl. ..... 110/235; 110/346

[58] Field of Search ..... 110/248, 235, 241, 251, 110/346, 349; 431/202

[56] References Cited

U.S. PATENT DOCUMENTS

| | | | |
|---|---|---|---|
| 1,729,572 | 9/1929 | Evans | 110/235 |
| 1,795,771 | 3/1931 | Golovtchikoff | 110/235 |
| 3,076,421 | 2/1963 | Spitz | 110/346 |
| 3,344,758 | 10/1967 | Wotschke | 110/227 |
| 3,610,180 | 10/1971 | Scott | 110/215 |
| 3,664,278 | 5/1922 | Steen | 110/254 |
| 3,745,939 | 7/1973 | Albritton | 110/212 |
| 3,822,983 | 7/1974 | Proctor et al. | 431/202 |
| 3,861,333 | 1/1975 | Krumm | 110/259 |
| 3,862,609 | 1/1975 | Eff | 110/193 |
| 3,889,608 | 6/1975 | Pitt | 110/216 |

*Primary Examiner*—Edward G. Favors

*Attorney, Agent, or Firm*—Weiser, Stapler & Spivak

[57] ABSTRACT

A pollution controlled incinerator system comprises an elongated combustion products duct system having a series of spaced incineration station inlets positioned above ground level and a permanently installed pollution control apparatus. The branch combustion product duct from a remote station terminates at a more proximate station whereby when two or more portable incinerators are installed, the combustion products from the incinerator station further from the pollution control apparatus pass through the charge of the next proximate incinerator station in the series. The combined combustion products effluent from all of the incinerators or furnaces installed along the duct system is concentrated and directed to the permanently installed pollution control apparatus. The pollution control apparatus functions to clean and to cool the combustion products effluent and then to discharge the effluent to atmosphere.

10 Claims, 1 Drawing Figure

POLLUTION CONTROLLED INCINERATION SYSTEM

RELATED APPLICATION

This application is a continuation-in-part of application Ser. No. 806,831, filed June 15, 1977 by Albert W. Spitz and Milton I. Schwab, entitled "Pollution Controlled Incineration System".

BACKGROUND OF THE INVENTION

The present invention relates generally to portable incineration devices, and more particularly, is directed to a pollution controlled incineration system comprising two or more portable incinerators or primary combustion chambers, a connecting duct system and a non-portable air pollution control apparatus.

As set forth in our co-pending application, the cleaning of flue gases or exhaust gases from combustion processes is an important consideration and workers in this field must conform to rather strict air pollution control design parameters when designing and installing new incinerator and furnace installations. As previously set forth, the existing design criteria are particularly troublesome to meet when it is desired to remove the combustible insulation from scrap electrical wire in order to reclaim the copper and aluminum from the wire. Because of the ungainly and bulky nature of the piles of scrap wire, the most expeditious method of handling such material has been found to include the use of portable, conical, shell type incinerators which are moved by crane over the pile of scrap wire and then incineration of the combustible materials is initiated within the area defined by the shell of the portable incinerator.

In our said co-pending application, the concept of employing a permanently installed air pollution control apparatus in combination with a plurality of primary combustion chambers and interconnecting duct work has been set forth. This present invention is directed to further improvement in the system described in the said co-pending application.

SUMMARY OF THE INVENTION

The present invention relates generally to the field of air pollution control equipment as applied to a portable incineration system, and more particularly, is directed to a system encompassing permanently installed combustion products ducts, permanently installed air pollution control equipment, and a plurality of fixed duct inlets or combustion stations in combination with a portable primary combustion chamber for use at each such station.

The incineration system of the present invention utilizes a duct system means which preferably is installed sufficiently below ground level to prevent damage from portable yard equipment which is employed for scrap wire piling operations and incinerator moving purposes. The duct system is designed in a series arrangement comprising a plurality of combustion stations wherein each station is connected to a branch duct. It is the essence of this system that the branch duct from a more remote combustion station terminates at the next proximate combustion station. Accordingly, when two or more portable furnaces or portable incinerators are installed respectively at series connected combustion stations, the combustion products from the most remote combustion station will be directed by its branch duct through the charge of the next proximate combustion station, in series. In this manner, the gases of combustion from more remote stations can be concentrated and can be utilized in the insulation removal process of the downstream incinerator or combustion stations, that is, the combustion stations located more proximately to the pollution control equipment.

In measurements taken in the pollution controlled incineration constructed in accordance with the teachings of the co-pending Ser. No. 806,831, applicants have found that temperatures in the range of 1100° F. to 1400° F. are present in the duct system immediately prior to entering the permanently installed pollution control apparatus. Such temperature range is considered sufficient to break down the insulation of scrap wire, which insulation is basically organic in nature and generally includes materials such as polyvinylchloride, polyethylene, phenolic plastic, rubber, and other similar materials commonly employed for wire insulation purposes, to carbon and volatile compounds, the exact compositon of which, for the purposes of this invention, need not be analyzed in detail.

It is to be noted that the carbon generally adheres to the wire and is brittle in nature. Accordingly, when the wire is being handled in unloading, quantities of the carbon commonly drop off from the wire and can be conventionally disposed. In any event, it is usually not necessary in the art to remove the carbon from the wire, since the adhered carbon has the beneficial effect of preventing copper oxidation. Additionally, the carbon possesses some fuel value which is of benefit when the wire is subsequently processed, which process forms no part of the present invention. However, if found necessary, workers in the art can readily remove the carbon from the wire by mechanical processes, since the carbon is so brittle.

The volatile compounds which form part of the combustion gases have some fuel value, and by virtue of the series operation made possible by the present invention, these gases are concentrated by the series design. The heat in the effluent gases from the first or more remote combustion station minimizes the amount of combustion required for insulation breakdown in the more proximate combustion stations in the series chain, which in turn minimizes temperatures and thus oxidation of the metal in the more proximate units. In addition, the system functions to increase the concentration of combustible compounds in the downstream gases going to the afterburner whereby the volatile gases can be completely oxidized in the secondary combustion chamber with a minimum requirement of auxiliary fuel.

It is contemplated that the most remote combustion station in the chain could be charged with power wiring scrap, such scrap being characterized by relatively heavy gauge wire that does not readily oxidize and a relatively thick jacket of combustible insulation. The downstream combustion stations can be loaded with lighter wire, for example electronic wire scrap, which is characterized by fine gauge and which would reakily oxidize in conventional incinerators. By employing the heat of combustion from the more remote incinerator, the insulation from the electronic wire scrap can be removed without undue oxidation of the fine wire.

It is therefore an object of the present invention to provide an improved pollution controlled incineration system of the type set forth.

It is another object of the present invention to provide a novel, improved pollution controlled incineration system that incorporates a plurality of combustion stations arranged in series and having a common duct direct the combined gases of combustion to a permanently installed air cleaning station.

It is another object of the present invention to provide a novel, pollution controlled incineration system comprising a duct system, a plurality of combustion stations arranged in series along the duct system in a manner to concentrate combustibles in the gases leaving the duct system to materially reduce auxiliary fuel required for air cleaning purposes in a permanently installed pollution control apparatus.

It is another object of the present invention to provide a novel, pollution controlled incineration system characterized by a plurality of combustion stations arranged in series which is adapted to provide substantial reduction of wire oxidation in all downstream combustion stations.

It is another object of the present invention to provide a novel pollution controlled incineration system which comprises a plurality of combustion stations arranged in series, a plurality of portable primary combustion chambers suitable to respectively overfit each combustion station and a permanently installed secondary combustion chamber receiving the concentrated gaseous effluent from all of the primary combustion chambers to clean the effluent prior to exhaust to atmosphere.

It is another object of the present invention to provide a novel pollution controlled incineration system that is partly portable and partly fixed in construction, that is simple in design and that is trouble free when in operation.

Other objects and a fuller understanding of the invention will be had by referring to the following description and claims of a preferred embodiment thereof, taken in conjunction with the accompanying drawings, wherein like reference characters refer to similar parts throughout and in which:

DESCRIPTION OF THE PREFERRED EMBODIMENT OF THE INVENTION

Figure 1:
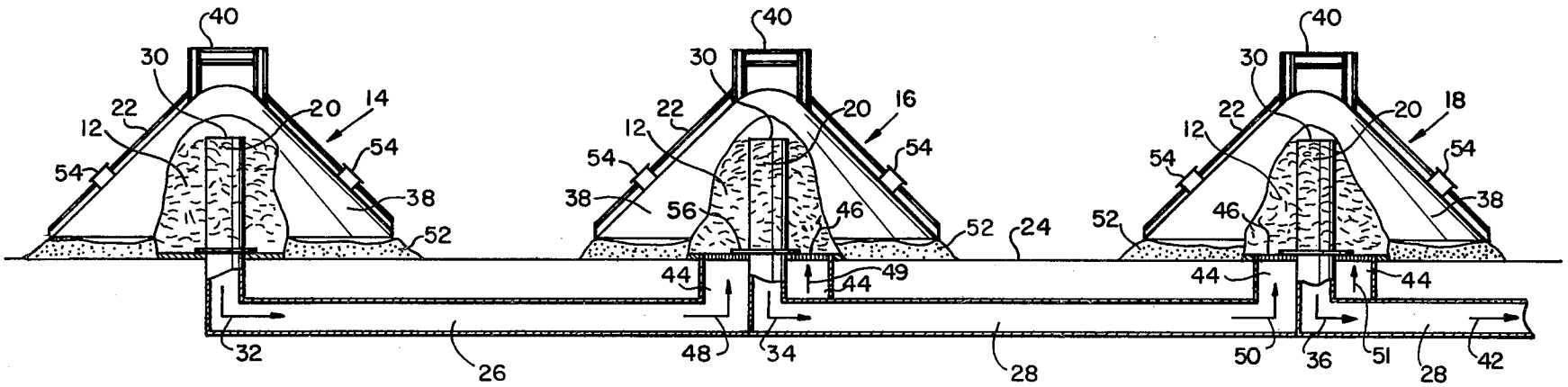
FIG. 1 is a schematic, elevational view showing the general arrangement of the combustion stations of the invention, with portions thereof partially broken away to expose details of interior construction.

Although specific terms are used in the following description for the sake of clarity, these terms are intended to refer only to the particular structure of the invention selected for illustration in the drawings, and are not intended to define or limit the scope of the invention.

Referring now to the drawing, there is illustrated a portion of an incineration system generally designated 10 which is suitable to treat piles of waste materials, for example scrap wire 12 in a manner to remove the insulation (not illustrated) from the wire at relatively low temperatures to reduce oxidation of the wire to a minimum. In the portion of the system illustrated, three combustion stations 14, 16, 18 in series arrangement are shown for purposes of illustration. It will be appreciated that a system constructed in accordance with the present invention can contain as little as two combustion stations or as many more than two as may be required to handle the capacity of the plant. However, all of the stations employed should be arranged for series operation.

Each combustion station 14, 15, 18 comprises a portable primary combustion chamber means or incinerator 22, a standpipe 20 which upwardly extends above ground level 24 and a branch combustion gas duct 26, 28. As set forth in our said co-pending application Ser. No. 806,831, each standpipe 20 is elevated above grade 24 to provide an elevated combustion gas inlet opening at each station 14, 15, 18, 30 which openings are spaced approximately six to eight feet above the grade 24. Each standpipe 20 defines a hollow combustion gas conduit and communicates with its respective branch duct 26 or 28 to convey combustion gases in the direction indicated by the arrows 32, 34, 36. The branch ducts 26, 28 should be of suitable size and configuration as necessary to carry the products of combustion from the various combustion stations 14, 16, 18, etc. as determined by known design considerations. Draft through the ducts is provided in known manner by the induced draft fans (not shown) of the pollution control equipment. The standpipes may be fabricated permanently fixed in position as illustrated or may be provided with a suitable heavy base (not shown) to permit the standpipe to be removed from association with its branch duct 26, 28 when not in use.

The portable primary combustion chambers 22 are fabricated to form a hollow, generally conical shell 38 with supporting structural frame members 40 to permit the primary combustion chambers to be lifted by a crane (not shown) or other yard equipment and placed directly over the standpipe and the surrounding pile of scrap wire 12 in the manner fully set forth in the said co-pending application Ser. No. 806,831.

In the system illustrated in the drawing, the combustion station 14 is indicated as being located at the remote end of the system, that is, the furthest from the permanent, pollution control apparatus (not illustrated) which is located downstream in the direction of the arrow 42 and which is fully described in our said co-pending application. The combustion stations 16, 18 (and any other combustion stations located sequentially downstream in the direction of the arrow 42 toward the fixed pollution control apparatus) are similarly designed and function to utilize the heat of combustion gases from more remotely located combustion stations in the manner hereinafter more fully set forth.

The branch duct 26 of the most remote combustion station 14 extends below grade and exhausts into the next proximal combustion station 16 in an upwardly extending exhaust duct 44. The exhaust duct 44 terminates upwardly at grade 24 in a suitable grating 46 having sufficient open area to permit the combustion gases generated in the more remote combustion station 14 to exit upwardly therethrough. Preferably, the exhaust duct 44 and grating 46 are substantially concentric with the standpipe 20 of the combustion stations 16, 18 more proximately located to the downstream pollution control equipment (not shown) whereby the hot gases from previous incineration processes travel upwardly directly through the pile of scrap wire 12 that has been previously piled about the standpipe 20. The exhaust gases (not illustrated) from each downstream combustion station 16, 18 travels downwardly through the respective standpipes 20 in the direction of the arrows 34, 36 and through the associated branch ducts 28. The branch ducts 28 pass through the side walls of the upwardly directed respective exhaust ducts 44 in a substantially leak-proof junction in well known manner whereby gases from the next upstream combustion station travel upwardly through the exhaust duct 44 and through the grating 46 as indicated by the arrows 48, 49 and 50, 51 and whereby the exhaust gases from within a downstream combustion station 16, 18 travel downwardly through the standpipe inlet 30, downwardly through the hollow interior of the standpipe 20 and through the branch duct 28 as indicated by the arrows 34 and 36.

In order to use the pollution controlled incineration system 10 of the present invention, scrap wire is placed in piles 12 about two or more series connected, upwardly extending standpipes 20 at combustion stations 14, 16 or others located downstream thereof. Usual yard equipment employed at the plant, such as bulldozers or cranes (not shown) can be utilized for this purpose. Portable primary combustion chambers 22 are then carried by their associated frames 40 and placed with the incinerator shells 38 covering entirely the pile of scrap wire 12 and the standpipe 20 at each respective combustion station 14, 16, 18, etc. Earth or other loose material 52 is then piled about the bottom periphery of the incinerator shells 38 to limit the amount of combustion air to thereby reduce interior temperatures. The primary combustion chamber air inlets 54 can be adjusted to admit just sufficient amounts of air to support combustion at reduced temperatures to achieve maximum insulating breakdown without wire oxidation. If desired, the standpipe 20 can be designed to be portable by providing a heavy metallic base 56 in the manner described in the said corresponding application.

Ignition of the pile of scrap wire 12 in the most remote combustion station 14 is first initiated and the organic materials comprising the wire insulation (not shown) are then incinerated at low heat and low speed to produce carbon and volatile compounds. The carbon (not shown) may adhere directly to the wire or due to its brittleness, may drop off when the wire is handled in unloading. In any event, a conscious effort to remove the carbon is not usually necessary since the carbon acts to prevent oxidation of the wire and additionally, contributes some fuel value when the wire is subsequently processed in the usual manner. However, if desired, due to its brittleness, the adhered carbon can be rather readily removed from association with the wire by mechanical vibration or other similar process.

The volatile gases of combustion within the primary combustion chamber 22 of the most remote combustion station 14 have some fuel value and are directed through the branch duct 26 towards the next downstream combustion station 16 as indicated by the arrows 32, 48, 49. The heat from the combustion in the primary combustion chamber 22 in the most remote combustion station 14 travels to the next downstream combustion station 16 and minimizes the amount of actual insulation combustion required in the combustion station 16 inasmuch as the previously generated heat can be utilized to break down the insulation of the wire within the pile 12 at the combustion station 16 into carbon and additional volatile compounds.

The volatile compounds and heat generated in the upstream incineration stations 14, 16 is concentrated within the downstream branch ducts 28 and this in turn minimizes the amount of actual insulation combustion required in the subsequent downstream combustion stations 18, etc. This in turn minimizes the oxidation of the wire metal in the subsequent or downstream combustion stations. Because of the series arrangement of the combustion stations 14, 16, 18 toward the downstream, permanently installed, air pollution control system (not illustrated in this application but fully described in the said co-pending application Serial No. 806,831), the volatile gases given off by the breakdown of the organic insulation materials are concentrated as the products of combustion travel through the series connected branch ducts 28 from downstream combustion station to further downstream combustion station. This increase in the concentration of combustible compounds in the gases traveling toward the permanent pollution control apparatus (not illustrated) further acts to reduce the amount of fuel required at the afterburners (not illustrated) normally installed in the secondary combustion chamber.

Thus, the combustion station 14 most remote from the pollution control equipment can be loaded with heavy material such as power wiring scrap, which has relatively heavy gauge wire that does not readily oxidize, and then the subsequent downstream combustion stations 16, 18, etc. can be loaded with lighter gauge wire, for example, electronic wire scrap, which is fine and which is usually readily oxidized in conventional incinerators. By so loading the various downstream stations 16, 18, the insulation materials can be removed at reduced temperatures, thereby leaving the wire substantially non-oxidized.

The series construction and operation of the incineration system 10 results in considerable increase of combustible compounds in the gases leaving the branch ducts 28 and going into the permanent air cleaning equipment (not illustrated) as indicated by the arrow 42, which concentration materially reduces the quantity of auxiliary fuel required for air pollution control purposes.

By utilizing the heat of combustion and the volatile compounds generated by incineration within the portable primary combustion chamber 22 of the most remote combustion station 14, substantial reduction of copper wire oxidation potential in all downstream units 16, 18, etc., can be achieved. In this manner, fine wire can be salvaged in the downstream units 16, 18, etc. without degradation and without utilizing additional auxiliary equipment.

It is also possible to direct the concentrated volatile gases which exit the last branch duct 28 in the direction indicated by the outlet arrow 42 directly into a blast furnace or other heat requiring equipment to take full advantage of the heat potential of the contained organics. Additionally, by employing such a design, the existing air pollution control equipment already installed (not illustrated) with the blast furnace could additionally be utilized to clean the pollutants generated at the various incineration stations 14, 16, 18, etc. without requiring additional capital outlay for pollution control equipment.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. In an incineration system suitable to remove insulation from wire, the combination of a plurality of combustion stations arranged in series relationship upstream from a pollution control apparatus, comprising at least one remote station and one proximate station, said remote and proximate stations including an inlet opening adapted to remove gaseous products of combustion from the respective said stations, said proximate station additionally comprising an exhaust opening adapted to receive gaseous products from the remote station, and said remote and proximate stations comprising a primary combustion chamber means adapted to overfit each inlet opening and a pile of insulation covered wire to permit the breakdown of the insulation within the space defined by the primary combustion chamber means into carbon and gaseous products of combustion; and a duct system means interconnecting the remote and proximate combustion stations to carry the gaseous products, said duct system means comprising a first branch duct adapted to lead in the gaseous products from the remote station to the proximate station and a second branch duct adapted to convey concentrated gaseous products from both the remote station and the proximate station to a downstream location.

2. The incineration system of claim 1 wherein the portions of said combustion stations are positioned above the ground level and other portions of said combustion stations are positioned below ground level.

3. The incineration system of claim 2 wherein the inlet openings are elevated above ground level to raise the effective height of the inlet opening above the said duct system means.

4. The incineration system of claim 1 and a standpipe connected to the first branch duct and the second branch duct, said standpipes rising above ground level and terminating upwardly in the said inlet openings.

5. The incineration system of claim 4 wherein the first branch duct, the second branch duct and the standpipe are nonmovable and wherein the primary combustion chamber means are adapted to be portable.

6. The incineration system of claim 1 wherein the first branch duct terminates at the proximate station in an exhaust duct.

7. The incineration system of claim 6 wherein the exhaust duct terminates upwardly to define the said exhaust opening.

8. The incineration system of claim 7 and a grating provided at the exhaust opening, said grating being adapted to allow the passage of gaseous products from the remote station into the proximate station.

9. The incineration system of claim 8 wherein the grating is positioned at ground level and wherein the grating is adapted to receive and support thereon a pile of insulation covered wire.

10. The incineration system of claim 1 wherein the first branch duct terminates at the proximate station in an exhaust duct and wherein the second branch duct is constructed to pass through the said exhaust duct.

* * * * *